United States Patent [19]

Wada

[11] 4,250,934

[45] Feb. 17, 1981

[54] LIQUID FILLING NOZZLE

[75] Inventor: Yoshinobu Wada, Matsuto, Japan

[73] Assignee: Shibuya Kogyo Co. Ltd., Ishikawa, Japan

[21] Appl. No.: 43,722

[22] Filed: May 30, 1979

[51] Int. Cl.[3] ..... B65B 3/12; B65B 3/32

[52] U.S. Cl. ..... 141/357; 141/260; 141/261; 141/275; 141/360

[58] Field of Search ..... 141/27, 258, 260, 261, 141/275, 351, 353, 357, 360, 392

[56] References Cited

FOREIGN PATENT DOCUMENTS 876658 4/1953 Fed. Rep. of Germany ..... 141/360

1025743 3/1958 Fed. Rep. of Germany ..... 141/360

*Primary Examiner*—Frederick R. Schmidt

*Attorney, Agent, or Firm*—Fidelman, Wolffe & Waldron

[57] ABSTRACT

A liquid filling nozzle for filling liquid into a container under pressure. A piston is housed in a cylinder in a reciprocatingly movable manner, and one end of a hollow shaft is attached to the piston. Liquid flows into the cylinder from a tank through a check valve. Then a container comes into contact with a holding means attached at the bottom end of the shaft. The container raises the shaft to pressurize the liquid in the cylinder, thereby a check valve provided at the bottom portion of the shaft opens to discharge the pressurized liquid into the container.

6 Claims, 3 Drawing Figures

PRIOR ART

LIQUID FILLING NOZZLE

BACKGROUND OF THE INVENTION

The present invention relates to a liquid filling nozzle to be used in liquid filling machines, in particular, to a liquid filling nozzle which is capable of filling a desired amount of various kinds of liquid into a container, such as a bottle or a can, from a liquid supply tank of liquid filling machines.

In general, liquid filling nozzles allowing to fill a container with a predetermined amount of liquid were well known. For example, one of the conventional liquid filling nozzles, as shown in FIG. 1, an outer cylinder 2 is pushed upward by a rod 1 to raise to the top end of a cup 3 above the liquid surface of a tank 4. Thus, a predetermined amount of the liquid fills the cup 3. Then a table 6, on which a container 5 is place, is lifted upward so that an inner cylinder 8 moves upward with respect to the outer cylinder 2 against a coil spring 7. Therefore small holes 9 come to be placed within the cup 3, which allows the liquid of a predetermined quantity inside the cup 3 to flow into the container 5 under gravity through an elongated hole 10. While, another example of the prior art is shown in FIG. 2, in which the cup 3 is provided at the bottom of the liquid supply tank 4, and a hole 11 is normally open to keep a predetermined amount of liquid in the cup 3. In order to transfer the liquid in the cup 3 to the container 5, the table 6 is lifted upward to move the container 5 and the inner cylinder 8 in the upward direction, which, in turn, cause a valve member 12, provided integrally at the top end of the cylinder 8, to close the hole 11 while opening a hole 9. As a result, the liquid with a predetermined quantity contained in the cup 3 flows into the container 5 under gravity through the elongated hole 10 of the inner cylinder 8. In the prior art as exemplified by these two cases as shown in FIGS. 1 and 2, it is to be noted that, although it is possible to fill a container with a predetermined amount of liquid, it usually requires an exorbitant amount of time to complete the filling process because it relies on gravity to cause the liquid to flow and, moreover, it is so structured that the liquid must flow through the small hole 9 and the elongated hole 10 of the inner cylinder 8, which is also relatively narrow. In addition, if the liquid is of high viscosity, the filling time could become virtually intolerable; and, therefore, the conventional filling nozzles could not be employed in many instances.

SUMMARY OF THE INVENTION

The primary object of the present invention is to provide an improved liquid filling nozzle which is capable of filling a container with a predetermined amount of liquid.

Another object of the present invention is to improve the liquid filling operation of a liquid filling nozzle by pressurizing the liquid during the filling operation thereby shortening the filling time.

A further object of the present invention is to provide a liquid filling nozzle having a wide applicability, which can deal with liquid of high viscosity advantageously.

A still further object of the present invention is to provide a liquid filling nozzle which can easily adjust the amount of liquid to be filled in a container.

A still further object of the present invention resides in the improvements in the liquid filling operation, in which the liquid filling operation is initiated by a container itself and the absence of a container does not trigger the filling operation, so that a nozzle of the present invention has a function of detecting the absence or presence of a container thereby a proper filling operation is secured.

Other objects, features, and advantages of the present invention will become apparent after a reading of the remainder of this specification and the attached drawings.

DESCRIPTION OF THE PREFERRED EMBODIMENTS

Figure 1:
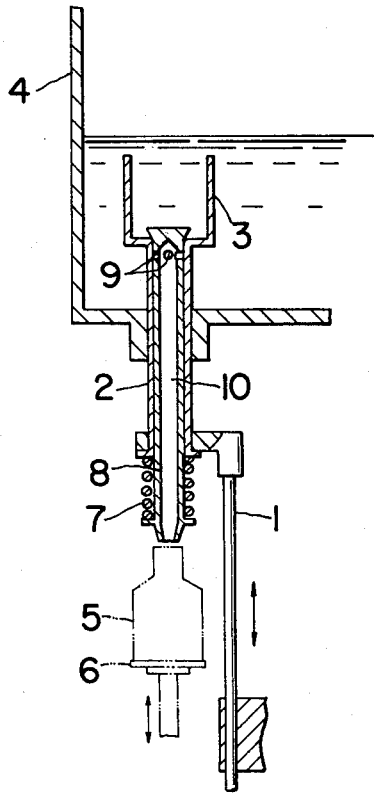
FIG. 1 is a side sectional view illustrating one example of the conventional liquid filling nozzles.
Figure 2:
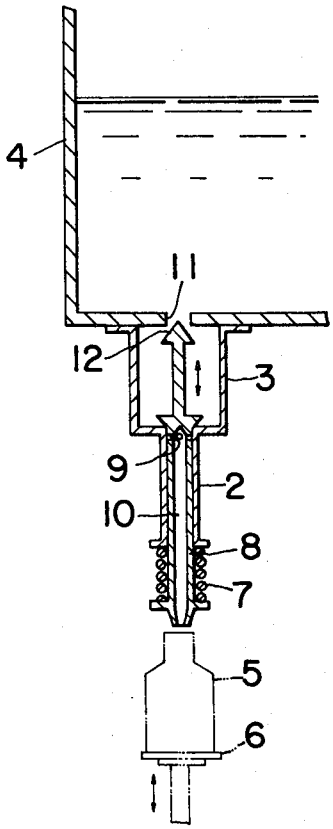
PRIOR ART FIG.2
FIG. 2 is a side sectional view illustrating another example of the conventional liquid filling nozzles.
Figure 3:
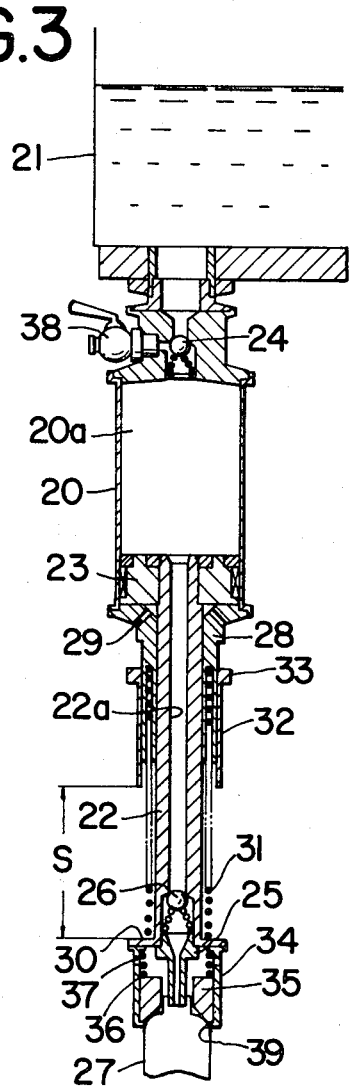
FIG. 3 is a side sectional view illustrating one embodiment of the present invention.

Referring to FIG. 3, a liquid filling nozzle in accordance with the present invention comprises, in general, a cylinder 20 capable of temporarily storing a predetermined amount of liquid, a piston 23 housed in the cylinder 20 in a reciprocatingly movable manner and a hollow shaft 22 one end of which is attached to the cylinder 20 to present a guide passage for the liquid to flow into a container 27, such as a bottle. The cylinder 20 is located below a liquid supply tank 21 and can be connected hydrodynamically to the interior of the tank 21 through a check valve 24. While, an inner chamber **20*a* of the cylinder 20 is always connected hydrodynamically to an elongated hole 22*a* of the shaft 22. At the bottom end of the shaft 22 is attached an injection nozzle 25, and a check valve 26 is provided at the bottom portion of the shaft 22 in the proximity of the injection nozzle 25. The check valve 26 allows the liquid to flow only in the direction from the elongated hole 22*a* of the shaft 22 to the injection nozzle 25 when it is open. It is preferable to make the injection nozzle 25** long enough so that the tip thereof can be placed inside the mouth of the container at the time of liquid filling process.

Since it is so structured that the shaft 22 can move the piston upward with respect to the cylinder 20 the top end of which is fixedly mounted at the botton of the tank 21, the liquid inside the cylinder 20 and the shaft 22 can be pressurized. Thus hightened liquid pressure causes the check valve 26 to open and, therefore, the liquid starts to flow into the container 26 through the injection nozzle 25. On the other hand, when the shaft 22 goes down to lower the pressure inside the cylinder 20, the check valve 24 becomes open to permit the liquid in the tank 21 to flow into the inner chamber **20*a* of the cylinder 20. In this manner, the inner chamber 20*a* of the cylinder 20** is always filled with the liquid.

A bottom end 28 of the cylinder 20 holds the shaft 22 slidably therethrough, and the piston 23 can rest against the inner surface of the bottom end 28. A plurality of small holes 29 are provided in the bottom end 28 so as to facilitate the reciprocating motion of the piston 23. At the bottom end of the shaft 22 is formed a flange 30 and a spring 31 is provided in such a way that one end presses against the bottom end 28 and the other end against the flange 30. Thus the shaft 22 is pressed downward under the force of the spring 31 to keep the piston 23 normally in contact with the inner surface of the bottom end 28.

The bottom end 28 has a threaded portion on a part of its outer side surface, on which a stopper nut 33 fixedly mounted on a cylindrical stopper 32 is screwed. The bottom end of the stopper 32 is engageable with the flange 30 thereby determining distance s of the motion of the shaft 22 and, therefore, the piston 23. By adjusting the position of the stopper 32 with respect to the bottom end 28, the distance s can be easily selected to fill the container 27 with any desired amount of liquid. It is also conceivable to provide a threaded portion partly or fully on the inner side surface of the stopper 32 so that the stopper 32 can be directly screwed into the threaded portion of the bottom end 28.

To the bottom surface of the flange 30 formed at the bottom end of the shaft 22 is attached a cylindrical member 34, in which a guide cone 35 for holding the top portion of the container 27 is slidably fitted. A spring 36 which is strong in force than the spring 31 is provided to exert a force on the guide cone 35 in the downward direction. Thus, if the container 27 happens to move upward beyond the preselected moving distance s of the shaft 22 for some reason, this difference is absorbed by the spring 36 thereby detrimental effects to other parts of the nozzle due to the unexpected motion of the container 27 are advantageously avoided. Small holes 26 are provided at appropriate positions of the cylindrical member 34 so that the air comming out of the container 27 during a liquid filling process can be discharged outside. A stopper ring 39 is formed at the bottom end of the cylindrical member 34, and the guide cone 35 is normally pressed against the stopper ring 39 under the force of the spring 36. Furthermore, a drain cock 38 is provided at the top end of the cylinder 20 and in the vicinity of the check valve 24, and is normally connected hydrodynamically to the inner chamber **20*a* of the cylinder 20. If air is trapped inside the inner chamber 20*a***, the drain cock can be opened to release the trapped air.

Now, explanation will be given as to the liquid filling operation with the use of the present liquid filling nozzle having a structure as described above. When a table (not shown) on which the container 27 is placed moves upward, the top portion of the container 27 comes into contact with the guide cone 35 and the shaft 22 starts to move in the upward direction against the force of the spring 31. This causes to raise the liquid pressure inside the inner chamber **20*a* and the elongated hole 22*a*. When the liquid pressure has risen beyond a certain level, the check valve 26 opens to allow the liquid flow into the container 27 under pressure. In this instance, the air inside the container 27 is displaced by the filling liquid and the displaced air can be discharged outside of the nozzle through the small holes 37. When the flange 30 of the shaft 22 comes into contact with the bottom end of the stopper 32, the upward motion of the shaft 22 becomes restrained and the liquid filling operation ceases because the check valve 26 closes. In this manner, a desired amount of liquid determined by the moving distance s of the shaft 22, or the piston 23, can be filled in the container 27. If the container 27 continues to move upward for some reason even though the upward motion of the shaft is restrained by the stopper 32, the guide cone 35 in contact with the top portion of the container 27 moves upward relative to the cylindrical member 34 against the force of the spring 36. Because of this, inadvertent breakage of the container 27** is advantageously avoided and no detrimental effects to other parts of the nozzle occur.

Upon completion of filling the container 27 with the predetermined amount of liquid, the container 27 is now moved downward, which, in turn, causes the shaft 22 to go down due to the recovering force of the spring 31. Then, the check valve 24 is opened to allow the liquid reserved in the tank 21 to flow into the inner chamber **20*a*. Thus, the inner chamber 20*a*** is supplied with the liquid to prepare for the next liquid filling operation of a container.

As described above in detail, in accordance with the present invention, the liquid temporarily stored inside the nozzle is pressurized and the liquid filling operation takes place under pressure. Therefore, the time required to complete the liquid filling operation has been shortened considerably and the present nozzle can be advantageously used even for liquid with high viscosity.

It will be understood that various changes in details, materials and arrangements of parts, which have been herein described and illustrated in order to explain the nature of the invention, may be made by those skilled in the art within the principle and scope of the invention as expressed in the appended claims. However, while the invention has been described with reference to the structure disclosed herein, it is not to be confined to the details set forth, and this application is intended to cover such modifications or changes as may come within the scope of the following claims.

What is claimed is:

1. A liquid filling nozzle for use in liquid filling machines in which containers are filled with a predetermined amount of liquid successively, comprising cylinder means having top and bottom ends and housing a piston in a reciprocatingly movable manner, said bottom end being provided with at least one through-hole, first liquid flow control means provided at the top end of said cylinder means for controlling the supply of liquid into said cylinder means, hollow shaft means having a top end which is attached to said piston and which passes through the bottom end of said cylinder, second liquid flow control means provided at the bottom portion of said hollow shaft means for controlling the liquid flow from said cylinder means, resilient means operatively provided between said cylinder means and said hollow shaft means for exerting a force on said hollow shaft means in the downward direction, holding means provided at the bottom end of said hollow shaft means for holding the top portion of said container, and valve means hydrodynamically connected to the inner chamber of said cylinder means for releasing the air trapped in said inner chamber.

2. A liquid filling nozzle according to claim 1, wherein each of said first and second liquid flow control means comprises a check valve.

3. A liquid filling nozzle according to claim 1, further comprising stopper means adjustably connected to the bottom end of said cylinder means and flange means provided on said hollow shaft means to be engageable with said stopper means.

4. A liquid filling nozzle according to claim 3, wherein said resilient means comprises a coil spring extending between the bottom end of said cylinder means and said flange means.

5. A liquid filling nozzle according to claim 3, wherein said holding means comprises a cylindrical member having an inwardly projected portion at its bottom end, a guide cone slidably housed in said cylindrical member, and resilient means for pressing said guide cone against the projected portion of said cylindrical member.

6. A liquid filling nozzle according to claim 1, further comprising an injection nozzle attached to the bottom end of said hollow shaft means, said nozzle being long enough to be partly inserted into the mouth of said container at least during the filling operation.

* * * * *